US011877661B2

(12) United States Patent
Tejeda

(10) Patent No.: US 11,877,661 B2
(45) Date of Patent: Jan. 23, 2024

(54) SLING HEADREST

(71) Applicant: Evelyn Tejeda, Boynton Beach, FL (US)

(72) Inventor: Evelyn Tejeda, Boynton Beach, FL (US)

( * ) Notice: Subject to any disclaimer, the term of this patent is extended or adjusted under 35 U.S.C. 154(b) by 41 days.

(21) Appl. No.: 17/559,827

(22) Filed: Dec. 22, 2021

(65) Prior Publication Data

US 2022/0192386 A1 Jun. 23, 2022

Related U.S. Application Data

(60) Provisional application No. 63/133,589, filed on Jan. 4, 2021, provisional application No. 63/130,055, filed on Dec. 23, 2020.

(51) Int. Cl.
*A47C 16/00* (2006.01)
*A47G 9/10* (2006.01)

(52) U.S. Cl.
CPC ..... *A47C 16/00* (2013.01); *A47G 9/10* (2013.01)

(58) Field of Classification Search
CPC ..... A47C 16/00; A47C 9/10; A47C 7/383; A47C 7/356; A47C 7/38; A47C 21/022; A47C 21/029; A47G 9/1009; A47G 9/007; A47G 9/1045; A47G 19/1036; A47G 19/1054; A47G 19/1072; A47G 19/109; A47G 2200/146
USPC ..... 248/118
See application file for complete search history.

(56) References Cited

U.S. PATENT DOCUMENTS 1,314,002 A 8/1919 Lee
2,581,802 A * 1/1952 Lyons ..... A47G 9/1009 5/643
2,722,692 A * 11/1955 Dempster ..... A61G 7/0755 5/648
3,035,279 A * 5/1962 Stead ..... A47G 9/1009 5/639
4,802,252 A * 2/1989 Marmor ..... A47C 21/024 5/505.1
4,956,881 A 9/1990 Lindley et al.
(Continued)

FOREIGN PATENT DOCUMENTS

CN 108835988 A 11/2018
CN 213721190 U 7/2021
(Continued)

*Primary Examiner* — Nkeisha Smith

(57) ABSTRACT

A recumbent head support system, designed as an alternative to conventional sleep pillows, comprising a frame which suspends a fabric platform that is adjustable for height, weight-bearing distribution and shifting of pressure point. It is a headrest that enables the user to personalize a desired level of support without having to lift their head off the support. The headrest suspension system includes base cross support members, a panel or base framework secured to base cross support member, vertical members secured to base cross support members, and a pair of horizontal members cantilevered and rotatably secured to vertical members (or upper cross support member), and a fabric sling that attaches to the rotatable horizontal members. Optionally, user-actuated control elements are provided to fine-tune height, concavity/droop, tilt and pitch of fabric platform.

9 Claims, 4 Drawing Sheets

(56) References Cited

U.S. PATENT DOCUMENTS

| | | | | |
|---|---|---|---|---|
| 5,337,429 | A * | 8/1994 | Tucker | A47G 9/1009 5/636 |
| 6,221,036 | B1 * | 4/2001 | Lucas | A61G 7/075 602/5 |
| 6,581,226 | B1 * | 6/2003 | Brustein | A47G 9/1063 5/636 |
| 7,048,700 | B1 * | 5/2006 | Gustie | A61H 1/0296 601/39 |
| 7,669,602 | B2 * | 3/2010 | McGinnis | A61B 6/0421 128/845 |
| 7,673,356 | B1 * | 3/2010 | Conyers | A45D 44/10 5/636 |
| 7,753,610 | B2 * | 7/2010 | Gehrke | A61G 13/1245 403/109.8 |
| 9,241,861 | B2 * | 1/2016 | Bissell | A61H 1/0218 |
| 10,881,900 | B2 | 1/2021 | Brask | |
| 11,058,915 | B2 | 7/2021 | Brask | |
| 11,202,522 | B2 * | 12/2021 | Sakamoto | A47C 7/383 |
| 2008/0276375 | A1 * | 11/2008 | Gehrke | A47C 20/021 5/648 |
| 2014/0249461 | A1 * | 9/2014 | Bissell | A61H 1/0218 602/36 |
| 2019/0053647 | A1 * | 2/2019 | Sakamoto | A47G 9/1045 |

FOREIGN PATENT DOCUMENTS

| | | | |
|---|---|---|---|
| DE | 8914159 | U1 | 5/1990 |
| DE | 202004017299 | U1 | 12/2004 |
| JP | 2005323633 | A | 11/2005 |
| JP | 5054401 | B2 | 10/2012 |

* cited by examiner

SLING HEADREST

CROSS-REFERENCE TO RELATED APPLICATION

This application claims priority to U.S. Provisional Patent Application No. 61/63,130,055, filed Dec. 23, 2020, and U.S. Provisional Patent Application No. 61/63,133,589, filed Jan. 4, 2021, the entirety of which is incorporated herein by reference thereto.

FIELD

The present invention relates generally to headrests and pillows, and, more specifically, to a headrest suspension system having a sling fabric platform and a frame that may be adjustable or fixed.

BACKGROUND

Beds and pillows are well known in the art. Their early existence in the U.S. Patent and Trademark Office is evidenced by their inclusion in Class 5 of the old U.S. Patent Classification that includes devices ordinarily known as beds, examining tables, operating tables, hammocks, cradles, cribs, cots, camp beds, ground mats, sleeping bags, and bed accessories, such as mattresses, pillows, surgical supports, and bed clothing.

Pillows have evolved into many forms and it has been shown that the best position for an individual's head and neck is a pillow that supports the curve of the neck, such that when a user is sleeping on their back, their head and neck reflect the same good posture as when standing. However, many attempts to encourage proper head and neck positioning when sleeping restrict him/her from sleeping on his/her side or stomach.

U.S. Pat. No. 2,581,802 to Lyons discloses a sling headrest that generally comprises a frame and a fabric or flexible material slung between the elevated, longitudinally extending frame members as a sling for a user's head. The frame includes a pair of the base members extending from a fore-end of the frame and a connecting lateral crossmember. Vertical fore-frame members are connected to the opposing longitudinal base members. Each pair of vertical fore-frame members bend or rotate as much as 90° from the vertical plane established by the vertical fore-frame members.

U.S. Pat. No. 6,581,226 to Brustein discloses an open frame pillow and a pillow support system. The pillow support system generally comprises a frame and includes an open pillow slipcover suspended vertically above the mattress. The frame includes opposing vertical fore-frame members, opposing longitudinally extending base frame members attached at their fore-end to the vertical members, and upper, longitudinally extending opposing frame members. These frame members do not move with respect to each other.

Chinese published patent disclosure CN 213721190 to Du discloses a collapsible, adjustable pillow frame that is arranged to hold a headrest slung on the elevated longitudinally extending frame members. The pillow frame includes opposing lateral crossmembers, opposing longitudinally extending lower members, opposing vertically extending fore-frame members, and opposing longitudinally extending upper frame members. Each of these members include slots that are arranged to accept and/or connect the frame members to adjacent crossmembers or to connect a member to a connector joint. The lower, cross and upper frame members appear to have a singular slot arranged to connect the members to a respective connector joint or and adjacent member. The upper connecting joints appear to have multiple slots at 90° angles with respect to each other allowing the upper connectors and the upper longitudinal frame members to be rotated 90° with respect to the vertical fore-frame members. A sling is arranged to provide a headrest support between the upper, longitudinally extending frame members.

One problem with prior art systems is that they are normally not adjustable to accommodate different sized individuals needing different height settings and levels of support during sleep repositioning.

Thus, there is a need for an adjustable headrest that supports a proper curvature of the cervical spine while still allowing him/her to lay in different positions such as on their side or stomach or back on a stable device.

SUMMARY

The invention provides a sling headrest that overcomes the herein fore-mentioned disadvantages of the heretofore-known devices and methods of this general type.

In general, the sling is a recumbent head support system that consists of a frame which suspends a fabric platform. Its function is to support the head when the user is in the recumbent positions of supine (lying on one's back, face up) or lying on his or her side. It allows the user to adjust the height and level of support in a controlled manner to meet their anatomical, cervical spine alignment needs. When the head is supported with the cervical spine in normal anatomical alignment, there is decreased stress on the surrounding ligaments and vertebral discs, in turn, promoting relaxation of the local postural muscles and minimizing restlessness.

One concern this headrest addresses relates to customization. Most bed pillows are not adjustable, and users compensate for the lack of customization by attempting to puff up or fold the pillow, using more than one pillow to achieve the needed height, or they end up using their arms or hands to cradle their head to attain the needed support. This may compress body parts and restrict blood flow, including sensitive areas like the carotid sinus and blood vessels on the side of the neck.

Unlike standard bed pillows, the headrest system of the present invention offers adjustability for height of support, surface area covered/weight bearing distribution and shifting of pressure point.

This headrest also addresses a potential concern relating to off gassing of volatile organic compounds (VOCs). The flexible fabric sling material, hung between upper, longitudinally extending frame elements, is made of materials void of potentially toxic emissions. This is important considering the proximity of one's respiration to the pillow surface. Many of the bed pillows on the market today are made with petroleum based synthetic materials (polyester/polyurethane/memory foams) which do off-gas VOCs. Additionally, some pillows (even some of the natural feather, down or cotton fill pillows) undergo chemical treatments which outgas due to its composition and/or breakdown (flame retardants/antimicrobials/pesticides). Some of these chemicals are considered persistent organic pollutants and hormonal, endocrine disrupting chemicals. Regardless of claims that these VOCs are at low levels, persons should not breathe in these potentially irritating/sensitizing vapors. The headrest's suspension fabrics are woven using natural materials that do not off-gas VOCs.

The headrest will provide a breathable rest surface, minimizing the retention of body heat. The headrest can easily be sanitized. The preferred suspension fabric is an organic cotton material that will be offered in a selection of thicknesses and stretch to accommodate user preferences. The fabric will be easily detachable for cleaning and replacement and is machine washable. It will be cleaned as simply as washing a pillowcase. This is important considering the soil and bodily secretions that accumulate on the sleep surface (e.g., saliva, sweat, dead skins cells, natural skin oils, skin products). Regular washing of the fabric minimizes concerns with allergens such as dust mites or respiratory pathogens such as mold, bacteria, and viruses. Also, there is less risk for bed bug infestation.

The headrest frame can be easily wiped clean. Some embodiments of the headrest frame are collapsible for easy stowing of the collapsed frame. The headrest can be made as a sustainable product. The long lasting/recyclable metal frame supports the biodegradable/recyclable fabric sling. The floor base or under-mattress frame insert may be a PVC material.

The user has an option of resting his or her head directly on the fabric platform sling material or adding their favorite pillow on top of the sling and adjusting the platform height to meet a desired comfort level. In the side lying position, the lower arm of the sleeper can rest freely under the headrest, and the upper arm of the sleeper may be placed on the platform facilitating chest expansion.

In one embodiment, the present invention broadly comprises a sling headrest suspension system including a frame having a first cross support member, a first pair of vertical members secured to and extending upwardly from the cross support member, a second base cross support member, and a panel or base framework secured to the second base cross support member extending cantilevered from the second base cross support member. A single vertical member is secured to and extends upwardly from the second base support member and has an upper end secured to a mid-sectional region of the first cross support member. A pair of horizontal members are secured to and extend cantilevered from the first pair of vertical members. A sling is secured to the pair of horizontal members.

In another embodiment, the present invention broadly comprises a sling headrest suspension system including a frame having a first base cross support member, a first pair of vertical members secured to and extending upwardly from the base cross support member, a second base cross support member, and a panel or base framework secured to the second base cross support member extending cantilevered from the second base cross support member. A second pair of vertical members secures to and extends upwardly from the second base cross support member securing to a distal end of the first pair of vertical members. A pair of horizontal members are secured to and extend cantilevered from the first pair of vertical members. A sling is secured to the pair of horizontal members.

An enhancement of the single vertical support includes a user controllable height adjustment wherein the single vertical support is extendable, and hence also retractable.

The headrest has safety features to decrease risk of physical injury. The present invention provides a device that provides proper curvature of a person who is laying down. Also, the present invention provides a device that vertically adjusts to an individual's anatomical dimensions. The sling's slack, or droop or degree of concave support is adjustable such that an individual can adjust the concave sling. The sling of the present invention provides proper neck support, curvature and comfort.

Although the invention is illustrated and described herein as embodied in a sling headrest, it is, nevertheless, not intended to be limited to the details shown because various modifications and structural changes may be made therein without departing from the spirit of the invention and within the scope and range of equivalents of the claims. Additionally, well-known elements of exemplary embodiments of the invention will not be described in detail or will be omitted so as not to obscure the relevant details of the invention.

Other features that are considered as characteristic for the invention are set forth in the appended claims. As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one of ordinary skill in the art to variously employ the present invention in virtually any appropriately detailed structure. Further, the terms and phrases used herein are not intended to be limiting; but rather, to provide an understandable description of the invention. While the specification concludes with claims defining the features of the invention that are regarded as novel, it is believed that the invention will be better understood from a consideration of the following description in conjunction with the drawing figures, in which like reference numerals are carried forward. The figures of the drawings are not drawn to scale.

Before the present invention is disclosed and described, it is to be understood that the terminology used herein is for the purpose of describing particular embodiments only and is not intended to be limiting. The terms "a" or "an," as used herein, are defined as one or more than one. The term "plurality," as used herein, is defined as two or more than two. The term "another," as used herein, is defined as at least a second or more. The terms "including" and/or "having," as used herein, are defined as comprising (i.e., open language). The term "coupled," as used herein, is defined as connected, although not necessarily directly, and not necessarily mechanically. The term "providing" is defined herein in its broadest sense, e.g., bringing/coming into physical existence, making available, and/or supplying to someone or something, in whole or in multiple parts at once or over a period of time.

In the description of the embodiments of the present invention, unless otherwise specified, azimuth or positional relationships indicated by terms such as "up", "down", "left", "right", "inside", "outside", "front", "back", "head", "tail" and so on, are azimuth or positional relationships based on the drawings, which are only to facilitate description of the embodiments of the present invention and simplify the description, but not to indicate or imply that the devices or components must have a specific azimuth, or be constructed or operated in the specific azimuth, which thus cannot be understood as a limitation to the embodiments of the present invention. Furthermore, terms such as "first", "second", "third" and so on are only used for descriptive purposes, and cannot be construed as indicating or implying relative importance.

In order to describe functional aspects of the present invention, frame elements of the sling are designed to rotate or be angularly moved in three dimensions. The term "fore" refers to frame elements near or adjacent the head of the bed or the headboard and hence, the sling fabric itself, is near or on the head of the bed or the headboard (that is, near or at the top of the user's head or skull). The rotation or angular movement of various inventive components is discussed in relationship with x, y and z coordinates forming the sling frame. The vertical z-axis lies in and is co-planar with the opposing vertical fore-frame members and, with respect to the vertical fore-frame members, an angular or rotational movement or yaw of opposing upper frame members occurs when opposing upper extension frame members or frame elements rotate with respect to the vertical z-axis plane. A lateral y-axis is defined by the laterally extending fore-frame element and, angular or rotational movement or pitch occurs when, for example, the terminal ends of opposing upper extension frames move or swing inward or towards each other, in the y direction such that the distance between the terminal ends of opposing upper frames is less than the lateral span of laterally extending fore-frame element. A longitudinal x-axis defined by opposing longitudinally extending upper frame members extending from the vertical fore-frame member plane and an angular or rotational movement or roll occurs when, for example, the terminal ends of opposing upper frames rotate about an axis defined by each individual upper frame element as shown by arrows (clockwise) and (counterclockwise).

At the terminal end of upper opposing frame elements, a controllable element enables the user to adjust the depth or concave size, and hence the tension, of the resilient sling fabric or material by either rotating the control in the prescribed direction to tighten or reduce the concave condition of the suspended sling fabric or to move the controlled end to loosen or increase the concavity of the salon fabric. Also, the control knobs at the terminal end of the upper frame members can provide a control system to adjust the yaw or angular disposition of the upper opposing frame members with respect to the fore-end vertical plane.

The upper opposing frame members provide support for the slung fabric. These upper longitudinally extending frame members provide a foundation for the slung fabric which wraps around each frame member. The control mechanisms at the terminal end of the upper frame members allow both clockwise and counterclockwise rotational adjustment of the slung fabric. Of course, the degree of concave suspension provided by the system is reduced when the right-side terminal end control is rotated clockwise and the left side terminal control is rotated counterclockwise. These rotational controls increase or decrease the slack, laxity and suspension of the bridge-like suspended slung fabric. This function, in turn, serves to increase or decrease the weight bearing surface area of support, that is, the load distribution and the height of the sling support.

The upper opposing frame members also offer a yaw or tilt function which further serves to shift the weight bearing pressure point or points established by the user's head on the slung fabric. The lateral span of the upper frame members or elements (in the y direction) is also adjustable as described later. However, one embodiment of the present invention provides a frame suspension which is altered or adjustable to typical pillow widths such as Standard, Queen or King (26 inch, 30 inches, and 36 inch lateral spans). The longitudinal span or length of the upper frame members, in one embodiment, is approximately 16 inches. In another embodiment, the width or lateral span of these upper frame members can be adjustable as discussed later. When the suspended or slung fabric platform receives the weight bearing load from the user, the anterior aspect (longitudinally displaced from the vertical fore-end plane defined by opposing vertical frame elements), will shift medially, that is, decrease the pitch of the longitudinal upper frame elements, to decrease slung fabric tension, that is, to increase laxity, and to minimize compressive forces on the user's lower facial area and neck.

In one further enhancement of the present invention, there is a left and right control or adjustment control system which permits the fore-end vertical frame elements to be adjusted to a comfortable vertical height selected by the user or to reduce the overall vertical height of the sling frame and further permitting the user to remove the sling frame from the bed and stow the frame away as needed. Also, the invention may include control elements which allow the opposing upper frame elements to be moved medially or laterally, that is, to change the pitch of the longitudinally extending frame members.

In a further modification, the fore-end vertical frame members need not be straight nor disposed in a singular vertical plane. In one embodiment of the present invention, the vertical height in the z axis permits the opposing vertical frames to be adjusted up or down, in a telescoping manner.

In a further embodiment of the present invention, the frame system may include one or more fore-end cross members laterally spanning distance y and being connected to opposing vertical fore-end frame members. In one embodiment, the lateral span of the system in the y axis is about 24 inches. It is contemplated that there may be up to 3 cross member supports, one cross member at the top of opposing vertical frame elements, one cross member at a mid-level position or intermediate the upper and lower terminal ends, and a third cross member at the lower terminal end of the vertical frame members.

The suspension fabric may be a fabric with a variable stretch function that is attached to or suspended between the opposing upper longitudinal frame elements. It is contemplated, in one embodiment, that the longitudinal span of the slung fabric will be approximately 13 inches.

In one embodiment, frame system may include lower base members extending longitudinally from the lower terminal ends of the opposing vertical fore-end frame elements. This base frame system can be placed on the floor or can be placed between the mattress and the mattress frame, bedframe platform, box spring or any other type of platform which supports the mattress, to secure the sling on the bedframe. In one embodiment, these base frame elements may be made of some type of plastic or PVC-type material. The base frame system may include one, two or more cross bar members to increase the stability when the entire framework is installed with the base framework interposed between the mattress and the bedframe platform. In some situations, the base framework may be placed on the floor beneath the bed with the addition of extendable opposing vertical fore-end frame members.

In a further embodiment, the upper longitudinal frame members may, upon activation of a control elements discussed later, rotate about 90° to change the pitch to a fully collapsed condition to stow away the entire framework. In this mode, these upper frame members are placed substantially in a fore-end vertical plane formed by opposing vertical frame members. Another possible storage position is enabled by the collapse the vertical frame members (or the single vertical frame member) onto themselves, which thereby reduces the vertical span in the z direction to substantially match the height of the mattress, or, for storage, to collapse the vertical frame to its minimum telescopic condition.

Typically, the weight of an adult user's head is about 8-12 pounds. However, the sling frame may account for the weight of a user's arm and the nominal weight of the pillow. The vertical height of a user's head is about 10 inches and the lateral span of a typical adult user head is about 6.5 inches. A typical broad-shouldered adult has about a 20-inch lateral shoulder span than from left to right shoulder joint.

BRIEF DESCRIPTION OF THE DRAWINGS

Further objects and advantages of the present invention can be found in the detailed description of the invention. Various embodiments are disclosed, by way of example only, with reference to the accompanying schematic drawings in which corresponding reference symbols indicate corresponding parts.

DETAILED DESCRIPTION

Figure 1:
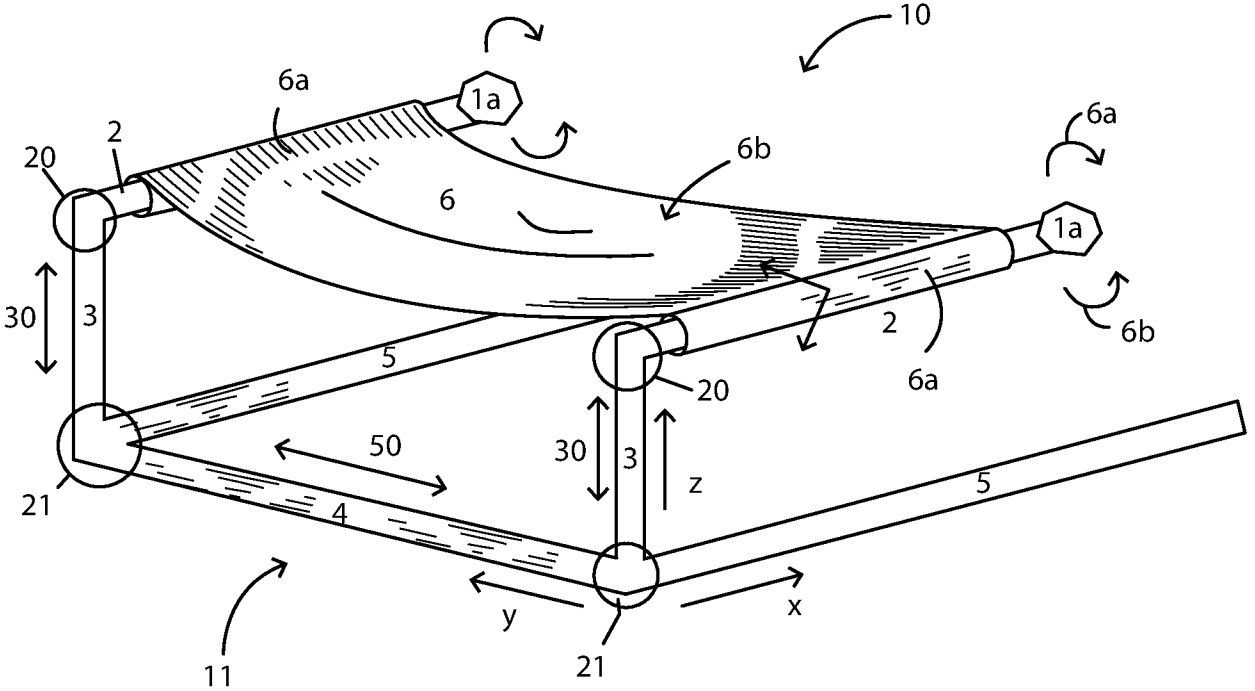
FIG. 1 shows a perspective view the freestanding embodiment of the present invention.

At the outset, it should be appreciated that like drawing numbers on different drawing views identify identical, or functionally similar, structural elements. It is to be understood that the claims are not limited to the disclosed aspects. Furthermore, it is understood that this disclosure is not limited to the particular methodology, materials and modifications described and as such may, of course, vary. It is also understood that the terminology used herein is for the purpose of describing particular aspects only and is not intended to limit the scope of the claims. Unless defined otherwise, all technical and scientific terms used herein have the same meaning as commonly understood to one of ordinary skill in the art to which this disclosure pertains. It should be understood that any methods, devices or materials similar or equivalent to those described herein can be used in the practice or testing of the example embodiments.

It should be appreciated that the term "substantially" is synonymous with terms such as "nearly," "very nearly," "about," "approximately," "around," "bordering on," "close to," "essentially," "in the neighborhood of," "in the vicinity of," etc., and such terms may be used interchangeably as appearing in the specification and claims. It should be appreciated that the term "proximate" is synonymous with terms such as "nearby," "close," "adjacent," "neighboring," "immediate," "adjoining," etc., and such terms may be used interchangeably as appearing in the specification and claims.

Sling headrest 10 generally comprises two essential components, a sling or bridge or suspended fabric 6, and frame 11. Sling 6 is arranged to provide a support for an individual's head when they are laying down, either on their back, sides, or stomach. Sling 6 is a fabric or other highly flexible material that does not release volatile organic compounds (VOCs). It may be made of other fabric or material. Preferably, sling 6 or slung fabric 6 forms a relatively flat or concave head support platform for the user's head.

Framework 11 (or frame system 11) includes a pair of opposing, longitudinally extending, generally horizontal, opposing members 2, 2, which may be tubes, solid rods, or any other suitable member. Upper opposing frame members 2, 2 each have two ends, one end having end cap 1*a* and the opposite fore-end engaging rotatable control connector 20, extending cantilevered from connectors 20, 20. Rotatable control connectors 20, 20 connect first or upper horizontal frame members 2, 2 to a terminal first end of vertical frame members 3, 3. It should be appreciated that rotatable control connector 20 may be a rotatable universal joint connector that allows movement in the x, y, or z axes. Rotatable control connector 20 may also be a hinged connector that allows movement in only the axis. If control connector 20 is a hinged connector, the pitch of the upper longitudinal frame members 2, 2 can be moved 90° to be near or in the fore-end vertical plane defined by opposing vertical frame members 3, 3.

Vertical frame members 3, 3 have second, lower terminal ends arranged distally in z direction in relation to the first upper terminal ends. Vertical frame members 3, 3 may be tubes, solid rods, or any other suitable member. Vertical frame members 3, 3 may also be expandable or telescoping to permit vertical adjustment 30 to configure framework 11 to an appropriate user height under the control of the user. Vertical frame members 3, 3 have second lower terminal ends that are slidably secured to cross base support frame member 4, via sliding control clamps 21, 21. Clamp 21 may be a ring clamp, or any other suitable connector that permits horizontal adjustment 50 along the length of cross support member 4.

Sling or bridge fabric 6 is arranged to allow a user's head to rest on the sling fabric platform. Sling fabric 6 includes loops or channels 6*a* arranged at opposite ends of sling 6. Loops or channels 6*a* are arranged to accept first longitudinally extending horizontal members 2, 2. When sling fabric 6 is engaged on horizontal upper frame members 2, 2, it creates a suspended fabric platform which may be substantially flat or having a substantially centered depression sling or concavity 6*b* is formed by sling 6. Sling depression 6*b* or the concave sling fabric or, if the sling is disposed in a substantially flat condition, supports a user's head when sling headrest system 10 is in use. When the user's head is on the fabric and in operational use, some concavity will be established. The laxity or degree of concave sling depression 6*b* of sling fabric 6 may be increased or decreased in depth by the adjustment of control elements which may be, in one embodiment, sliding control clamps 21, 21 at the lower terminal end for vertical frame elements 3, 3 as the lower cross bar frame elements 4 is laterally, horizontally upper adjusted in the y direction 50 along cross base support frame member 4. In other words, the control point 21 permits the user to collapse the lower cross bar frame elements 4 onto itself (or laterally expand in direction y) as desired by the user. The lateral adjustment in direction y necessarily changes the distance between vertical frame members 3, 3 and first longitudinal horizontal upper frame members 2, 2. The concavity or depression 6*b* of sling fabric 6 may also be adjusted via rotatable control connectors 20, 20.

Figure 2:
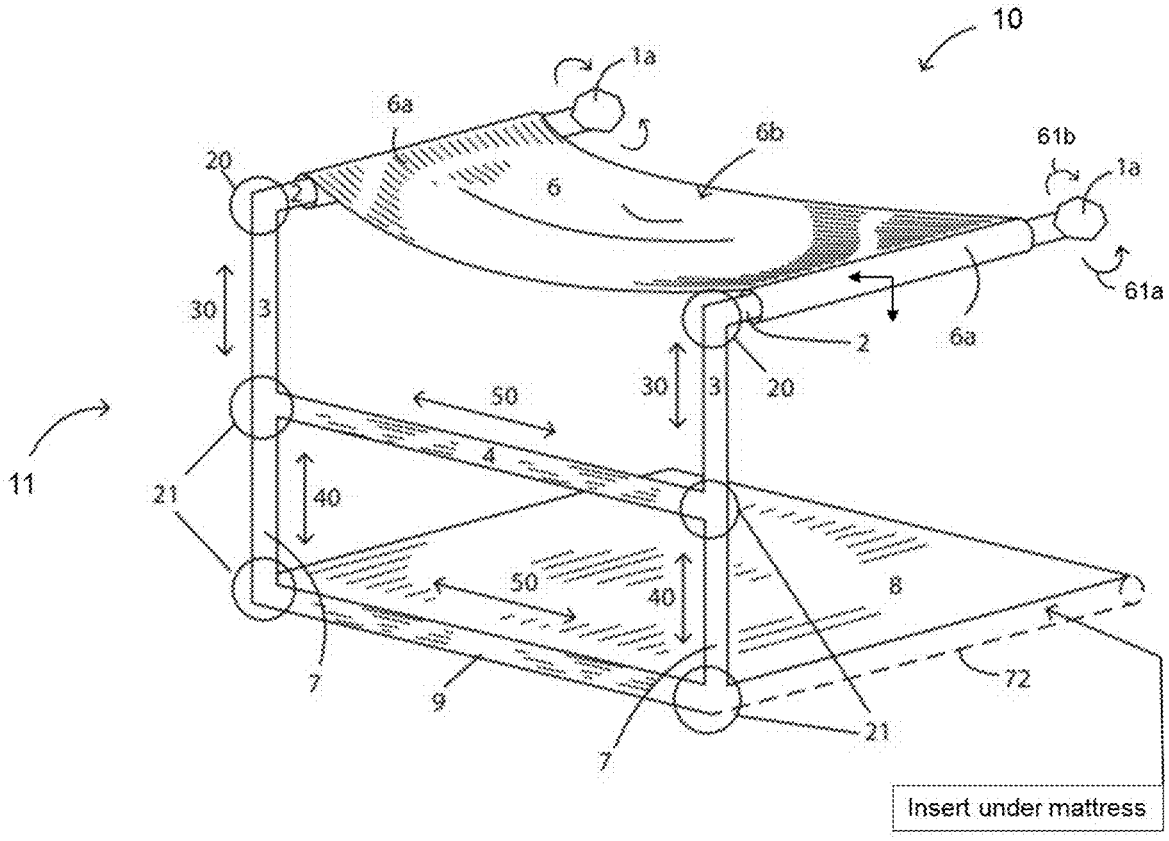
FIG. 2 shows a perspective view of an embodiment of the present invention.

FIG. 2 illustrates another embodiment of the present invention. It should be appreciated that in this embodiment the sling headrest system 10 includes some of the above-mentioned features. Mattress panel or underlaying floor plate 8 may be a plate or a base framework. Mattress panel or underlaying floor plate or base framework 8 is fixed to second cross base support frame member 9. Underlaying panel or floor base 8 may also be rotatably secured to frame member 9 via a ring clamp similar to clamp 21 at the terminal end of vertical frame elements 3. Underlaying panel or framework 8 is arranged to be slid underneath a mattress and in between the top surface of a box spring or bedframe, that is, intermediate the mattress and the box spring or bedframe or the panel base or framework 8 may sit on the floor under the bed.

Second lower vertical frame members 7, 7 are controllably arranged to expand in the z direction and adjust to the height of a mattress with a control element such that first upper cross base support frame member 4 is colinear with the top surface of a mattress and the second lower cross base support frame member 9 is either colinear with a top surface of a box frame or a top surface of a box spring.

It should also be appreciated that although the present invention contemplates either base members, base framework, or a base panel, to support sling fabric 6 and upper framework above the top mattress surface, alternative methods, such as a plurality of suspension members, e.g., leads, strings, chords, etc., may be used to attach sling 6 and frame 11 to a headboard. Further, it should also be appreciated that the configurations of attaching sling 6 to frame 11 may also be accomplished by a plurality of fasteners, snaps, or other removable attachment means to allow sling 6 to be removed for cleaning or replacement.

Underlaying panel or floor base framework 8 may also be rotatably secured to frame member 9 via a ring clamp similar to clamp 21, 21 at the terminal end of vertical frame elements 7, 7. Underlaying panel 8 is arranged to be slid underneath a mattress and in between the top surface of a box spring or bedframe bedframe, that is, intermediate the mattress and the box spring or bedframe bedframe or the panel base 8 may sit on the floor under the bed. It may be noted here that the headrest frame in FIG. 2 may be attached directly to the outer edge of a bedframe utilizing a clamp (not pictured) in lieu of using the underlaying panel or floor base.

Second vertical frame members 7, 7 are controllably arranged to expand in the z direction and adjust to the height of a mattress with a control element such that first cross base support frame member 4 is colinear with the top surface of a mattress and the second cross base support frame member 9 is either colinear with a top surface of a box bedframe or a top surface of a box spring or on the floor. The same is true for single vertical member 80 discussed later in connection with FIG. 3.

Figure 3:
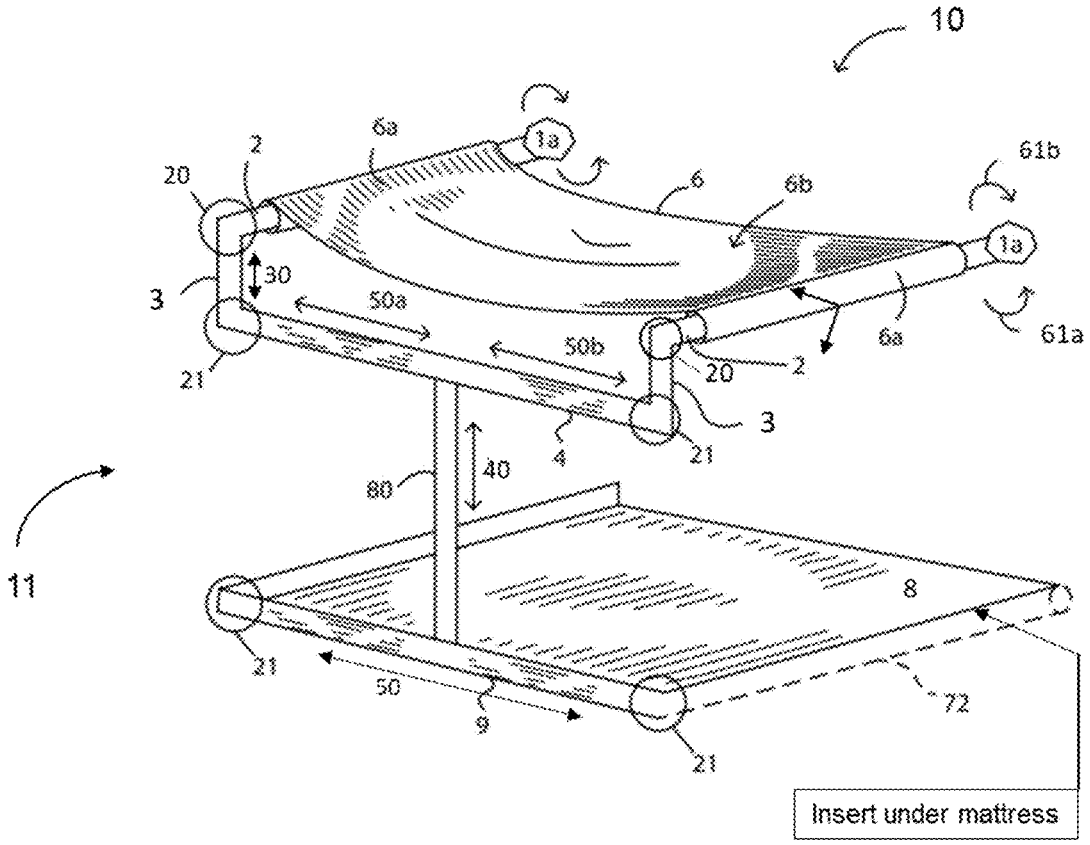
FIG. 3 shows a perspective view of a further embodiment of the present invention.
Figure 4:
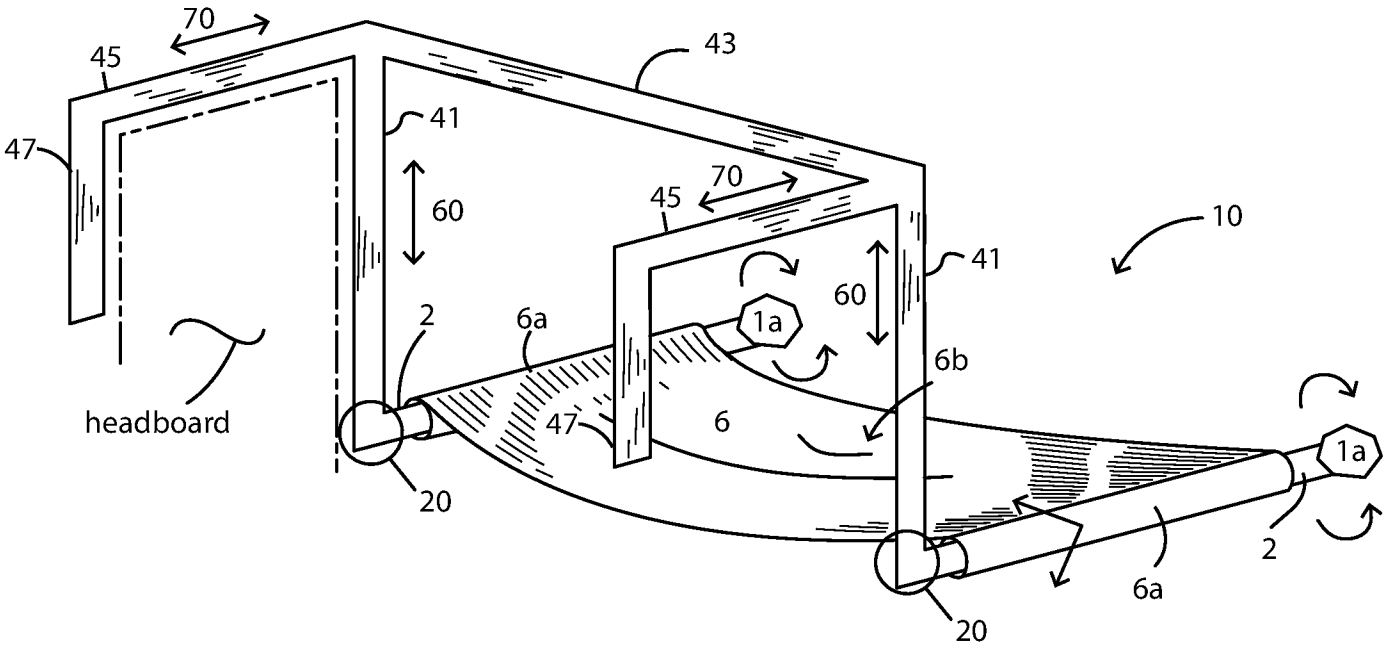
FIG. 4 shows a perspective view of yet another embodiment of the present invention which is adapted to be the hung over the headboard of the bed.

FIG. 3 is another embodiment of the present invention. Similar numerals designate similar items in FIGS. 2 and 3. It should be appreciated that in this embodiment the sling headrest system 10 includes some of the abovementioned features, except that there is only one lower vertical support member 80 secured to and located centrally between the first (upper) and second (lower) cross support members 4, 9. This vertical support member 80 is controllably arranged to expand telescopically to adjust to the height of the mattress with a control element such that the upper cross support member 4 is colinear with or above the top surface of a mattress and the lower cross support frame member 9 is either colinear with a top surface of a bedframe or box spring, or on the floor.

The sling headrest suspension system 10 includes a frame having a first cross support member 4, a first pair of vertical members 3, 3 secured to and extending upwardly from cross support member 4. A second base cross support member 9 is secured to a panel or base framework 8. Panel or base framework 8 extends cantilevered from the second base cross support member 9. A single vertical member 80 is secured to and extends upwardly from the second base support member 9 and has an upper terminal end secured to a mid-sectional region of the first cross support member 4. A pair of horizontal members 2, 2 are secured to and extend cantilevered from the first pair of vertical members 3, 3. A sling is secured to the pair of horizontal members.

An enhancement of the single vertical support in FIG. 3 includes a user controllable height adjustment at control point 1*a*, and possibly a second user actuated control point on the left-side of horizontal member 2 at left-side control point 1*a*. Also, the single vertical support 80 is extendable, and hence also retractable, as noted by arrows 30. Further, the sling fabric pitch, tilt and yaw can be controlled by actuation of control points 1*a*, 1*a* and the complementary mechanical actuators at connection 20, 20. Rather than panel 8, the base framework may be several horizontal members 72 on the left and right sides of base cross member 9.

Certain control elements are discussed herein. At the terminal end of upper opposing frame elements 2, 2, a controllable element 1*a*, 1*a* enables the user to adjust the tension and hence the depth or concave size of the resilient sling fabric or material 6 (otherwise referred to as the laxity of the fabric) by either rotating the control in the direction of arrow 61*a* to tighten or reduce the concave condition of the sling fabric or to move the control counterclockwise per arrow 61*b* to loosen or increase the concavity of the sling fabric. As an example, the control knob has a roll control (rotating about the axis formed by a single frame element 2) which may be a single or multiple gear teeth which co-acts with defined positional internal slots in the terminal end of the frames 2, 2. The control knob can be spring loaded and biased longitudinally inboard towards the fore-end vertical plane of elements 3, 3. The user pulls the control element outboard (away from the fore-end vertical plane) and rotates the gear knob to the desired position such that the fabric sling is tightened or loosened as desired. The gear teeth or control tab or tabs fall into the desired slot. Other rotational "fabric gathering and fabric loosening" controls may be used. Of course, rather than a "clockwise control to reduce concavity," at the manufacturer's discretion, the control could be a "counterclockwise control to tighten" the fabric. Also, such tension control may be configured such that all clockwise rotational controls on either the right or the left side of the upper longitudinal framework tightens the suspended sling fabric.

Also, the control knobs 1*a*, 1*a* at the terminal end of the upper frame members 2, 2 can also provide a control system to adjust the pitch or angular disposition of the upper opposing frame members with respect to the fore-end vertical plane. For example, the control element 1*a*, 1*a* can be pulled outboard (beyond the gear-tooth disengaged position) and an internal rod can be pulled and withdrawn from an aperture at control point 20, 20 near the terminal upper end of the vertical frame elements 3, 3 (which is complementary to control element 1*a*, 1*a*). For example, in control element 20, 20, one or more horizontally disposed apertures or holes in the vertical frame 3, 3 which are offset 10 degrees from a 90 degree "straight on" position (in the straight on position, the upper frames 2, 2 are located 90 degrees from the vertical fore-end plane of fore-end frame elements 3, 3). These pitch holes are formed in a single horizontal plane normal to the fore-end vertical plane. In this manner, by pulling the control rod outboard via control knob 1*a*, 1*a*, the fore-end of the rod is withdrawn from the 90 degree straight-on aperture, and the user can swing the upper framework 2, 2 in a pitch movement to reduce the lateral span between the two terminal outboard ends of the upper framework 2, 2. In a fully collapsed, lock mode when the upper framework 2, 2 is generally co-planar with vertical fore-end framework 3, 3, the control rod would be first moved outboard withdrawing the rod from the operative sling open position to a co-planar, fore-end closed position via control 20, 20. In this closed position, another aperture, 90 degrees from the fully open aperture position, enables the user to lock the upper framework closed in or about the fore-end vertical framework 3, 3 by placing the control rod in this 90 degree closed position.

The control mechanisms 1*a*, 1*a*, at the terminal end of the upper frame members allow both clockwise 61*a* and counterclockwise 61*b* rotational adjustment of the sling fabric (a roll control). Of course, the degree of concave suspension 6*b* provided by the system is reduced when the right-side terminal end control is rotated clockwise and the left side terminal control is rotated counterclockwise. These rotational roll controls permit the user to increase or decrease the slack, laxity and suspension of the bridge-like suspended sling fabric. This roll function, in turn, serves to increase or decrease the weight bearing surface area of support, that is, the load distribution on the sling and the height of the sling support.

In addition to the rotatable tension, roll control for the fabric sling, another control element at 20, 20 on the fore-end of the upper opposing frame members also offers a yaw or tilt function which further serves to shift the weight bearing pressure point established by the user's head on the slung fabric. This control element at 20, 20 includes, for example, a series of vertically disposed holes or apertures in the vertical fore-end framework 3, 3 and a control rod actuated by outboard controls 1*a*, 1*a*. An outboard movement of the control rod from a central OPEN aperture permits the user to change the yaw or tilt the upper frames 2, 2 up or down. For example, assuming that the OPEN horizontal position of the frames 2, 2 define a plane parallel to the plane defined by the lower framework 72, 72 or panel 8 and further assume that this defined horizontal position is a neutral pitch. The next higher hole above the neutral pitch hole in vertical frame 3, 3 defines a first pitch position. When the fore-end of the control rod is placed in that hole defining the first lower pitch position, the fabric sling 6 is sloped slightly downward from a higher fore-end location to a lower outboard location. Higher pitch holes below the neutral pitch hole make the outboard edge of fabric 6 higher than the lower forward edge of the fabric. Higher holes above the first lower pitch position increase the declination angle of the fabric from its forward edge to its outboard edge.

The lateral span of the upper frame members or elements (in the y direction) is also adjustable. Each cross-member frame element 4, 9, may have control elements to telescopically collapse or expand the lateral span of the system. One type of control element is a spring-loaded button lock which, when the button is placed in laterally displaced holes, the telescopically configured frame elements 4, 9 enable the user to select the proper lateral span y of the system. The user presses the button down, releasing the spring-loaded button from the first hole, then moves the telescopic tubes relative to each other such that the button snaps into the next selected y positional hole. Other telescopic, releasable and locking systems can be used such a cam-driven twist close, twist open lock. Another vertical adjustment controls could be spring-loaded laterally outboard facing control rods. The laterally outboard ends of these control rods fit into vertical position-defining apertures in the vertical frames 3, 3, which define the vertical positions of frame element 4. In a similar manner the longitudinal span of the upper frame members 2, 2 can be adjusted. However, control element 1*a*, 1*a* would be re-designed.

In one further enhancement of the present invention, there is a left and right control or adjustment system which permits vertical frame elements 3, 3 to be adjusted to a comfortable vertical height selected by the user or to reduce the overall vertical height of the sling frame and further permitting the user to remove the sling frame from the bed and stow the frame away as needed. These vertical control elements may be spring-loaded button locks, twist lock-unlock cam operated controls, or biased outboard actuated control rods similar to that discussed above in connection with the vertical adjustment mechanisms of vertical frames 3, 3.

In a further modification, the fore-end vertical frame members 3, 3 or the single vertical member 80 need not be straight nor disposed in a singular vertical plane. In other words, the vertical frame elements 3, 3 or 80 may generally be in a single plane. However, the discussion of roll, pitch and yaw requires reference to a single element or set of common elements.

In one embodiment of the present invention, the vertical height on the z axis permits the opposing vertical frames 3, 3 or vertical member 80 can be adjusted up or down, in a telescoping manner. As shown in FIG. 2, one vertical element, left side vertical element 3 has a vertical span longer or higher than the right-side vertical element 3. If this user actuated control feature is implemented in the framework, certain joints should be configured with pivotal joints.

In a further embodiment of the present invention, the frame system may include one or more fore-end cross members laterally spanning distance y and being connected to opposing vertical fore-end frame members 3, 3. These cross members may include lateral control elements as described above which alter the lateral span of the headrest suspension system.

In one embodiment, frame system may include lower base members extending longitudinally from the lower terminal ends of the opposing vertical fore-end frame elements 3, 3 as shown in FIG. 2. Although shown and described above as being a plate, the base frame elements may be lower opposing longitudinally extending elements 72 (the right-side frame being shown in broken lines in FIG. 2) similar in nature to the upper longitudinally extending frame elements 2, 2. This non-plate base frame system with the lower longitudinally extending elements 72 can be placed on the floor or these lower longitudinally extending elements 72 can be placed between the mattress and the mattress frame, bedframe platform, box spring or any other type of platform which supports the mattress, to secure the sling on the bedframe. In one embodiment, these lower base frame elements 72 may be made of some type of plastic or PVC material and may have a similar cross-dimensional shape as discussed above in connection with frames 2, 2. The base frame system may include one, two or more cross bar members, similar to cross bars 4, 9, to increase the stability when the entire framework is installed with the base framework 72 interposed between the mattress and the bedframe platform.

In some situations, the base non-plate lower framework 72 (with or without the lower cross bar members) may be placed on the floor beneath the bed. In this configuration, the lower vertical frame elements 7, 7 would extend from the floor (since the lower framework 72 is on the floor), extend above and adjacent the mattress box spring, extend above and adjacent the mattress itself and extend above the mattress. The height adjustment in the single vertical frame member 80 in FIG. 3 can also be adjusted as discussed above.

As discussed above, the upper longitudinal frame members 2, 2 may, upon activation of a control elements, rotate about 90° to change the pitch to fully collapse the entire framework. In this mode, these upper frame members are placed substantially in a fore-end vertical plane formed by opposing vertical frame members 3, 3.

Another possible stow-away position is enabled by the telescopic collapse of vertical frame members 3, 3 onto themselves as discussed above. This reduces the vertical span in the z direction to substantially match the height of the mattress and in some cases to collapse the entire system upon itself and into a generally single storage plane, limited only by the telescopic closeable limits of the vertical framework.

Another user-actuatable control includes vertical frame members 3, 3 or single member 80 having intermediate couplers or coupler that are slidably secured to cross base member 4, via sliding clamps 21, 21, and that are further connected at their respective second ends (now intermediate positions) to first or upper ends of second vertical members 7, 7. Second vertical members 7, 7 may be tubes, solid rods, or any other suitable member. Vertical members 7, 7 and frame 80 may also be expandable or telescoping to permit vertical adjustment 40. Frame 80 moves in directions 50*a*, 50*b* in FIG. 3. Control elements in frame elements 7, 7 and/or 3, 3 can enable the user to vertically adjust the height of the framework in the z axis. Vertical members 7, 7 have second terminal ends that are slidably secured to second (lower) cross base frame support member 9, via sliding clamps 21, 21. Sliding control clamp 21 may be a ring clamp, or any other suitable connector that permits horizontal, that is, lateral, adjustment in the direction of arrow 50 along the length of lower cross base support frame member 9. The same vertical control systems can be used on vertical frame 80.

The claims appended hereto are meant to cover modification and changes within the scope and spirit of the present invention. Thus, it is apparent that alternative embodiments of the invention are possible and intended to be within the scope of the appended claims.

What I claim is:

1. A sling headrest suspension system, comprising:

a frame comprising:

a first base cross support member;

a first pair of vertical members secured to and extending upwardly from said first base cross support member;

a second base cross support member;

a panel or base framework secured to said second base cross support member extending cantilevered from said second base cross support member;

a second pair of vertical members secured to and extending upwardly from said second base support member securing to a distal end of said first pair of vertical members; and, a pair of horizontal members secured to and extending cantilevered from said first pair of vertical members; and, a sling secured to said pair of horizontal members.

2. The sling headrest suspension system recited in claim 1 wherein said pair of horizontal members are rotatably secured to said first pair of vertical members.

3. The sling headrest suspension system recited in claim 1 wherein said first pair of vertical members may be slidably secured to said first base cross support member and said second pair of vertical members may be slidably secured to said second base cross support member.

4. The sling headrest suspension system recited in claim 1 wherein said sling has a first end and a second end, said first end and said second end having a loop, said loops are arranged to slidably secure said sling to said pair of horizontal members.

5. The sling headrest suspension system recited in claim 1 including at least one user actuated control element adjacent a terminal end of at least one of the pair of horizontal members which adjusts the concavity of the sling, the tilt of the sling with respect to the pair of vertical members or the pitch of the sling respect to the pair of vertical members.

6. The sling headrest suspension system recited in claim 1 wherein the first and second base cross support members are telescopic members and including a user actuated control element permitting lateral telescopic adjustment of the first and second base cross support members.

7. The sling headrest suspension system recited in claim 1 wherein at least one of the first and second pair of vertical members is a telescopic member and including a user actuated control element permitting height adjustment of the horizontal members and/or the first base cross support member.

8. The sling headrest suspension system recited in claim 1 wherein the first pair of vertical members are telescopic and including a user actuated control on the first base cross support member coacting with a complementary control element on the first pair of vertical members permitting vertical adjustment of the frame.

9. The sling headrest suspension system recited in claim 1 wherein the distal ends of said horizontal members may shift slightly downward and inward upon the introduction of a weight-bearing load onto the sling fabric platform to lessen sling fabric tension distally.

* * * * *